US011774909B2

(12) United States Patent
Bifrare

(10) Patent No.: US 11,774,909 B2
(45) Date of Patent: Oct. 3, 2023

(54) HOROLOGICAL DISPLAY MECHANISM WITH AN ELASTIC HAND

(71) Applicant: Montres Breguet S.A., L'Abbaye (CH)

(72) Inventor: Christophe Bifrare, Le Pont (CH)

(73) Assignee: Montres Breguet S.A., L'Abbaye (CH)

( * ) Notice: Subject to any disclaimer, the term of this patent is extended or adjusted under 35 U.S.C. 154(b) by 342 days.

(21) Appl. No.: 17/186,146

(22) Filed: Feb. 26, 2021

(65) Prior Publication Data

US 2021/0373497 A1 Dec. 2, 2021

(30) Foreign Application Priority Data

May 27, 2020 (EP) ..... 20176726

(51) Int. Cl.

| | |
|---|---|
| ***G04B 19/02*** | (2006.01) |
| ***G04B 13/00*** | (2006.01) |
| ***G04B 19/04*** | (2006.01) |
| ***G04B 45/00*** | (2006.01) |
| ***G04B 9/00*** | (2006.01) |

(Continued)

(52) U.S. Cl.

CPC ..... *G04B 19/02* (2013.01); *G04B 9/005* (2013.01); *G04B 13/001* (2013.01); *G04B 13/007* (2013.01); *G04B 13/008* (2013.01); *G04B 13/021* (2013.01); *G04B 19/042* (2013.01); *G04B 19/048* (2013.01);

(Continued)

(58) Field of Classification Search

CPC .... G04B 19/02; G04B 13/008; G04B 19/042; G04B 19/048; G04B 45/0061; G04B 9/005; G04B 13/001; G04B 13/007; G04B 13/021; G04B 19/082; G04B 13/02

See application file for complete search history.

(56) References Cited

U.S. PATENT DOCUMENTS 4,601,585 A * 7/1986 Farley ..... G04B 19/042 368/80

5,172,350 A * 12/1992 Walen ..... G04B 19/04 368/228

(Continued)

FOREIGN PATENT DOCUMENTS

| | | |
|---|---|---|
| CH | 715 211 A2 | 1/2020 |
| EP | 2 863 274 A1 | 4/2015 |
| EP | 3 605 244 A1 | 2/2020 |

OTHER PUBLICATIONS

European Search Report of 20 17 6726.6 dated Oct. 28, 2020.

*Primary Examiner* — Sean Kayes

*Assistant Examiner* — Sean R Brannon

(74) *Attorney, Agent, or Firm* — Sughrue Mion, PLLC

(57) ABSTRACT

A horological display mechanism with an elastic hand (1) for driving, about a shaft (D), pipes mounted at the ends of a flexible blade (3), arranged to deform the flexible blade (3), including a mechanism acting on the drive train of the first pipe (2) and of the second pipe (4) and which includes two planetary wheels (82; 84) for driving the pipes (2; 4), and an input planet-carrier chassis (180) for driving the hand (1), and rotatable with a regulation cam (801), the track (802) of which includes a rising edge and falling edge. An elastic arm (803) has a distal end which cooperates with the track and a rising edge of which raises the elastic arm (803) away from the axis of the cam to consume torque, and a falling edge which makes the elastic arm move back towards the axis to restore torque to the system.

7 Claims, 6 Drawing Sheets

(51) Int. Cl.
*G04B 19/08* (2006.01)
*G04B 13/02* (2006.01)

(52) U.S. Cl.
CPC ..... *G04B 19/082* (2013.01); *G04B 45/0061* (2013.01); *G04B 13/02* (2013.01)

(56) References Cited

U.S. PATENT DOCUMENTS

| | | | | |
|---|---|---|---|---|
| 9,075,392 | B2 * | 7/2015 | Stranczl | G04B 45/0061 |
| 10,222,749 | B2 * | 3/2019 | Denden | G04B 45/0061 |
| 11,537,080 | B2 * | 12/2022 | Bifrare | G04B 13/021 |
| 2018/0341224 | A1 * | 11/2018 | Alagon Carrillo | G04B 13/005 |
| 2018/0341227 | A1 * | 11/2018 | Alagon Carrillo | G04B 13/001 |
| 2020/0218199 | A1 * | 7/2020 | Fleury | G04B 19/25 |
| 2021/0011433 | A1 * | 1/2021 | Bifrare | G04B 13/021 |
| 2021/0026305 | A1 * | 1/2021 | Stranczl | G04B 19/02 |
| 2021/0048782 | A1 * | 2/2021 | Stranczl | G04B 19/048 |
| 2021/0223740 | A1 * | 7/2021 | Stranczl | G04B 19/042 |

* cited by examiner

HOROLOGICAL DISPLAY MECHANISM WITH AN ELASTIC HAND

CROSS REFERENCE TO RELATED APPLICATIONS

This application is claiming priority based on European Patent Application No. 20176726.6 filed on May 27, 2020, the disclosure of which is incorporated herein in its entirely by reference.

FIELD OF THE INVENTION

The invention relates to an horological display mechanism with a variable geometry, including at least one elastic hand which includes a first drive pipe rigidly connected to a first end of a flexible blade, and a second drive pipe rigidly connected to another end of said flexible blade, and including a display index which, in an unstressed free state of said elastic hand in which both said first pipe and said second pipe are not subjected to any stress and are distant from one another, is distant from said first pipe and from said second pipe, the service position of said elastic hand being a stressed position in which said first pipe and said second pipe are coaxial to one another about an output shaft, said display mechanism including first means for driving said first pipe about said output shaft, and second means for driving said second pipe about said output shaft, said first drive means and second drive means being arranged to deform said flexible blade, by varying the angular position of said second pipe with respect to the angular position of said first pipe about said output shaft, and to vary the radial position of said display index with respect to said output shaft.

The invention relates to an horological movement including at least one such display mechanism.

The invention relates to a watch including at least one such movement, and/or at least one such display mechanism.

The invention relates to the field of horological display mechanisms, and more particularly for timepieces with complications, the invention can be used for both static timepieces such as pendulum clocks or clocks and watches, because of the small dimensions of the mechanism according to the invention.

BACKGROUND OF THE INVENTION

Good viewing of the display members on a timepiece is important for the user.

The dials of numerous timepieces are not circular, and it is of interest to have available solutions allowing to occupy the entire available surface, for an even better viewing.

The design of a display mechanism with a variable geometry allows to break a certain monotony of the displays, and to make the display livelier, with different appearances according to the time of day, or according to particular time periods. For example, out of a very large number of other possible uses, an AM/PM display can be simply provided by the shape of a hand, which has a first appearance during the twelve hours of the morning, and a second appearance during the rest of the day; day/night displays, time-zone displays, or others can also be distinguished.

Such a display mechanism with a variable geometry adds complexity to the timepiece, in particular a watch, and it is advantageous to limit both its volume to allow its insertion into a watch case having a small size for example for a ladies' watch, its complexity to limit the number of components and the cost of manufacturing and assembly, and to regulate its torque consumption in order to introduce the smallest possible disturbance into the operation of the watch.

SUMMARY OF THE INVENTION

Elastic hands, and display mechanisms including such elastic hands, have been described in the documents EP2863274, EP3159751, EP3605244, and EP3605243, incorporated here by reference, and which disclose numerous alternatives.

The invention intends to further simplify such a display mechanism with an elastic hand, and to make it even more compact and economical to produce, and to optimise its torque consumption.

The invention also intends to prevent any butting in this display mechanism with an elastic hand, by avoiding pushing a wheel, and by preferring wheels mounted in a dragging way.

For this purpose, the invention relates to an horological display mechanism with a variable geometry, according to claim 1.

The invention relates to an horological movement including at least one such display mechanism.

The invention relates to a watch including at least one such movement, and/or at least one such display mechanism.

BRIEF DESCRIPTION OF THE DRAWINGS

Other features and advantages of the invention will appear upon reading the following detailed description, in reference to the appended drawings, in which.

DETAILED DESCRIPTION OF PREFERRED EMBODIMENTS

Figure 1:
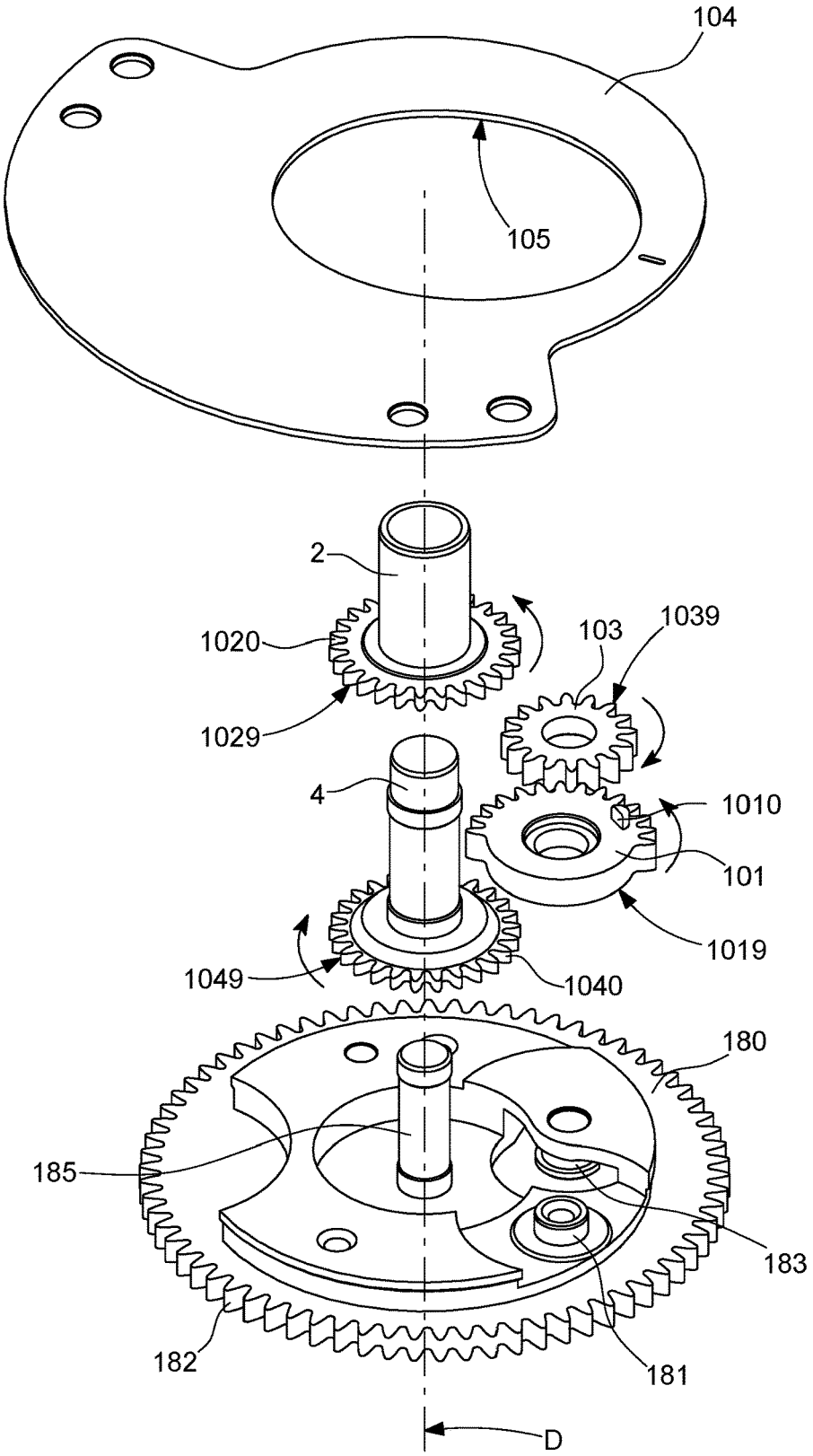
FIG. 1 shows, partially and schematically, in an exploded view, a display mechanism with an elastic hand, limited to the pipes of the elastic hand, which is not shown; this mechanism includes a mechanism of the differential type carried by a planet-carrier chassis, and the assembly thus shown forms an additional block adaptable onto an existing movement; here, the two pipes of the elastic hand are coaxial about a cannon-pinion arranged to form an output of such a movement.

The application EP3605244, relative to an horological display mechanism with a variable geometry with an elastic hand, discloses a first mechanism for actuation via wheels with shape teeth. Such an embodiment allows the execution of highly innovative display in horology, and is however costly, and limited to luxury pieces.

The same application further describes a second case of a mechanism for actuation via a first differential on the train of the first pipe and a second differential on the train of the second pipe, and at least one cam forming an input of such a differential. A suitable (differential) planetary gear should therefore be found and dimensioned. Planetary gears have the advantage of creating significant transmission ratios with a small bulk. The input and output shafts lie in the extension of each other. The possibilities of combination of gears are very numerous. They allow, in particular, to create gearboxes of interest. In the present case, this means controlling one of the inputs of the differential, in such a way as to generate a gain and respectively a loss of an equivalent specific value on each of the ends of the hand. And, when this value is zero, a transmission ratio of 1 must be obtained (the positive value means that the direction must also be identical).

The invention intends to further simplify the mechanism and make it even more compact and economical to produce. In particular, when the elastic hand must be implanted on a small piece, such as a ladies' watch, and moreover on the minute hand. The main difficulty is related to the low available torque. A mechanism with the smallest possible energy consumption, and especially as regular as possible, should thus be created.

The invention relates to a display mechanism with an elastic hand. Such an elastic hand, and display mechanisms including such elastic hands, have been described in the documents EP2863274, EP3159751, EP3605244, and EP3605243 incorporated here by reference, and which disclose numerous alternatives, in particular including one or more differential mechanisms.

The optimisation of the operation of such mechanisms requires a smoothing of the actuation torque. The torque consumed by the system is relatively large, whether it has one or two planetary wheels. There is a peak of consumption at the beginning of the rotation in the first 30° of the angular travel, then the torque decreases rapidly and becomes smaller, at a relatively low level, less than 20% of the maximum torque consumed during the peak, starting from an angle of rotation of 120° and until the end of the angular travel at 360°. This has the effect of reducing the amplitude of the inertial mass of the resonator, in particular of the balance, which can alter the chronometry and the power reserve.

For this purpose, the invention relates, more particularly, to an horological display mechanism 10 with a variable geometry, including at least one elastic hand 1.

This elastic hand 1 includes a first drive pipe 2 rigidly connected to a first end of a flexible blade 3, and a second drive pipe 4 rigidly connected to another end of the flexible blade 3.

Figure 5:
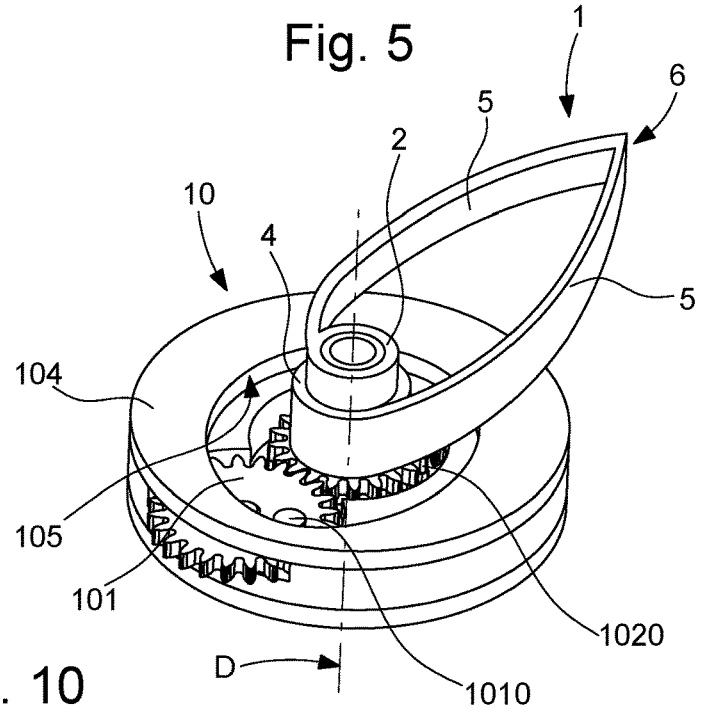
FIG. 5 shows, partially and schematically, and in perspective, a display mechanism according to the invention, with the elastic hand on its pipes.
Figure 10:
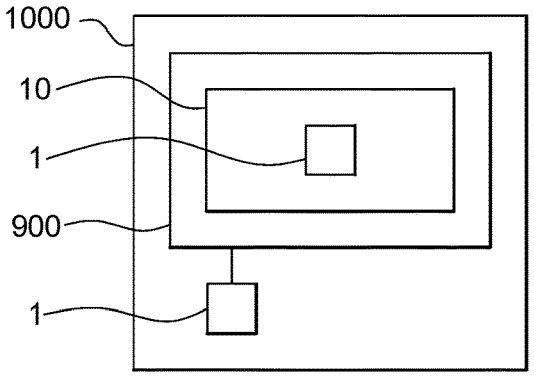
FIG. 10 is a block diagram of a timepiece including a movement and such a display mechanism.
Figure 6:
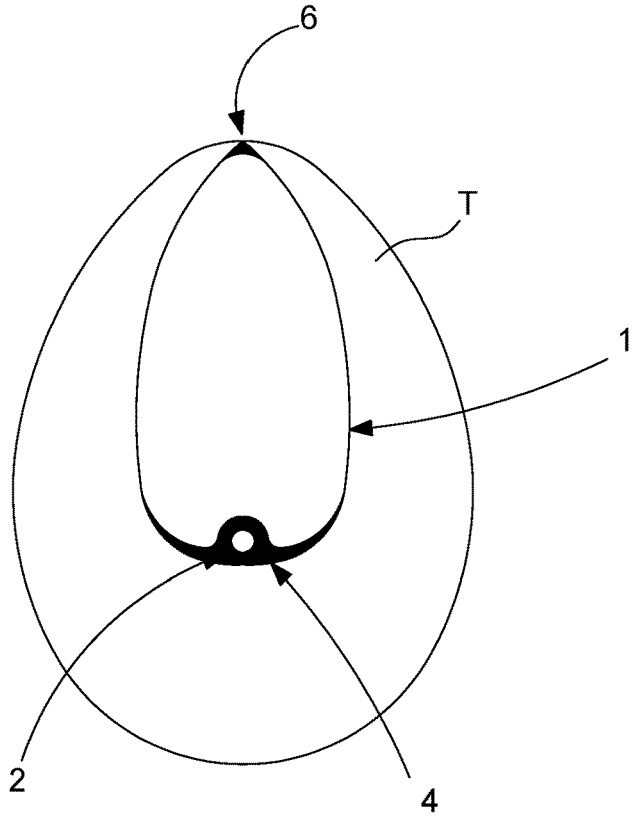
FIG. 6 illustrates, in a similar way to FIG. 4, the associated ovoid trajectory of a tip of the elastic hand.
Figure 7:
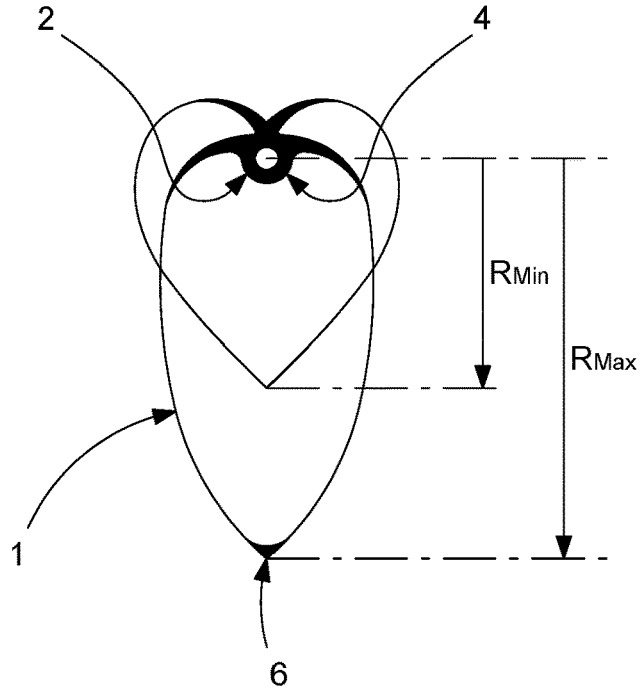
FIG. 7 illustrates, in a similar way to FIG. 4, the associated trajectory of a tip of the elastic hand, which successively takes the shapes of an almond and of a heart.

This flexible blade 3 can be a continuous blade, or a blade including a succession of segments 5 joined two by two at the tips 6, as visible in FIGS. 5 and 6.

This flexible blade 3 includes a display index which, in an unstressed free state of the elastic hand 1 in which both the first pipe 2 and the second pipe 4 are not subjected to any stress and are distant from one another, is distant from the first pipe 2 and from the second pipe 4, the service position of the elastic hand 1 being a stressed position in which the first pipe 2 and the second pipe 4 are coaxial to one another about an output shaft D. In particular in an alternative including segments 5 joined end to end, the display index advantageously, but not necessarily, consists of a tip 6.

The display mechanism 10 includes first means for driving the first pipe 2 about the output shaft D, and second means for driving the second pipe 4 about the output shaft D.

Alternatives in which the first pipe 2 and the second pipe 4 are not coaxial are not described here; they remain feasible for certain special displays, in particular displays which are not of revolution, like retrograde displays or similar.

The first drive means and the second drive means are arranged to deform the flexible blade 3, by varying the angular position of the second pipe 4 with respect to the angular position of the first pipe 2 about the output shaft D, and to vary the radial position of the display index with respect to the output shaft D. To improve the operation and ensure the regularity of energy consumption, a good solution involves equipping the display mechanism with an elastic hand with a torque regulator, and in particular rotationally coupling, in particular about the output axis D, a regulation cam 801 with a differential planet-carrier chassis, in particular an input planet-carrier chassis 180. This cam 801 cooperates with an elastic arm 803, in particular but not in a limiting way a pre-stressed spring. The track 802 of this regulation cam 801 comprises a continuous rising edge and falling edge, and has in particular an ovoid profile.

Thus, according to the invention, the display mechanism includes at least one mechanism of the differential type acting on the drive train of the first pipe 2 and on the drive train of the second pipe 4. And the differential mechanism includes at least a first planetary wheel 82 for driving the first pipe 2 and/or a second planetary wheel 84 for driving the second pipe 4, and at least one input planet-carrier chassis 180 that is driven in rotation by motor means for driving the elastic hand 1, and this display mechanism includes a torque-regulating mechanism acting on the input planet-carrier chassis 180.

More particularly, this torque-regulating mechanism includes, constrained to rotate with the input planet-carrier chassis 180, a regulation cam 801, the track 802 of which comprises a continuous rising edge and falling edge. The torque-regulating mechanism of the display mechanism includes an elastic arm 803, a distal end of which, or a runner 804 carried by the distal end opposite to its recess 805, permanently cooperates with the track 802, the rising edge of which raises the elastic arm 803 and moves it away from the axis of rotation of the cam 801 to consume torque, and the falling edge of which makes the elastic arm 803 move back down towards the axis of rotation of the cam 801 to restore torque to the system.

More particularly, the track 802 is symmetrical with respect to a plane passing through the axis of rotation of the input planet carrier 180, and, even more particularly, the track 802 includes an ovoid profile.

The distal end of the elastic arm 803, or a runner 804 carried by this distal end opposite to the recess 805 of the elastic arm 803, permanently cooperates with the track 802, the rising edge of which raises the elastic arm 803 and moves it away from the axis of rotation of the cam 801 which consumes torque, and the falling edge of which makes the elastic arm 803 move back down towards the axis of rotation of the cam 801 which restores torque to the system.

In the non-limiting example illustrated by the drawings, between approximately 70° and 360°, the regulation cam 801 raises the elastic arm 803, in particular at the runner 804, and thus consumes torque. Between 0° and 70° the elastic arm 803 moves downward on the side 802 of the cam 803 and provides torque to the system. This results in a curve of total consumption of the system that is much more regular, and with a lower maximum consumption. In the example illustrated the torque varies between 0.3 times and 0.4 times the value of the maximum torque during the peak of consumption of a mechanism not equipped with the invention.

This mechanism is comparable to the stackfreed of old clockwork: the stackfreed is a system invented in the $16^{th}$ century, already mentioned by Leonardo da Vinci, for the regulation of the force of a mainspring, in particular a barrel spring, during its letting down, and which includes a spring blade and an eccentric cam, to regulate the torque of the mainspring and improve the precision of a clock or of a watch. It includes a spring blade that bears more or less strongly on the contour of a cam carried by the axis of the barrel. The most prominent part of the cam is placed so that the stackfreed creates strong braking at the beginning of the letting down and the latter decreases as the spring is let down in the barrel. It thus allows to equalize over time the torque provided by the spring, and thus to improve the precision of measurement of the time.

The stackfreed includes in particular an overhanging elastic arm, including a runner at its distal end opposite to its fastening point. This runner bears on an eccentric cam track, in a snail shape. The cam is constrained to rotate with a wheel, which is part of a train driven by a shaft of the mainspring. This train is dimensioned in such a way as to make the cam carry out at most one rotation during the duration of letting down of the mainspring. The force applied by the elastic arm against the cam exerts a braking torque on the mainspring, which reduces the torque of the latter, which varies according to the radius of the cam. When the mainspring is completely wound, the elastic arm bears on the largest radius of the cam, and the braking torque exerted is thus maximum. During the letting down of the mainspring, the cam pivots, the elastic arm bears on increasingly smaller radii of the cam, which progressively reduces the braking torque, which compensates for the decrease in the torque generated by the mainspring. In one alternative, the cam wheel includes a stop face, to stop the letting down of the mainspring at the end of a useful range in which the torque delivered to the finishing train is substantially constant.

The braking exerted by the stackfreed logically translates into a loss of efficiency, which requires an oversizing of the mainspring, higher transmission ratios; its dimensioning is thus difficult for its use in a watch, which led to the general abandoning thereof starting in 1630, and to its replacement by other mechanisms that consume less energy, like the fusee mechanism.

However the stackfreed mechanism is simple, and its major advantage is its smaller bulk in terms of thickness than a fusee mechanism; its major disadvantage remains the necessary oversizing of the motor means and of the train to pass the torque safely.

The substitution of a cam with a continuous rising edge and falling edge, without a rupture of profile by a threshold, contrary to the snail cam of the old mechanisms, allows the use of this new alternative of the stackfreed with an elastic arm to ensure the torque regulation at the input of the display mechanism according to the invention.

Moreover, by diverting the normal operation of a differential, it is possible to control the planetary wheel. By implanting a feeler-spindle into the planetary wheel, and by controlling the latter by a round cam, a gear ratio equal to one is obtained between the sun gear and the chassis carrying the planetary wheels: the assembly thus behaves like a wheel.

The replacement of the round cam of this example with a cam having a suitable shape allows to control the gain or the loss that it is desired to obtain on the pipe. It should be noted that here again, the mechanism does not have a return spring to preserve the contact of the feeler-spindle on the cam, since it is the elastic hand that allows to carry out this function.

It is possible to avoid any phenomenon of butting and avoiding the use of a pushed wheel, in particular a planetary wheel, by preferring the use of dragging wheels.

Figure 8:
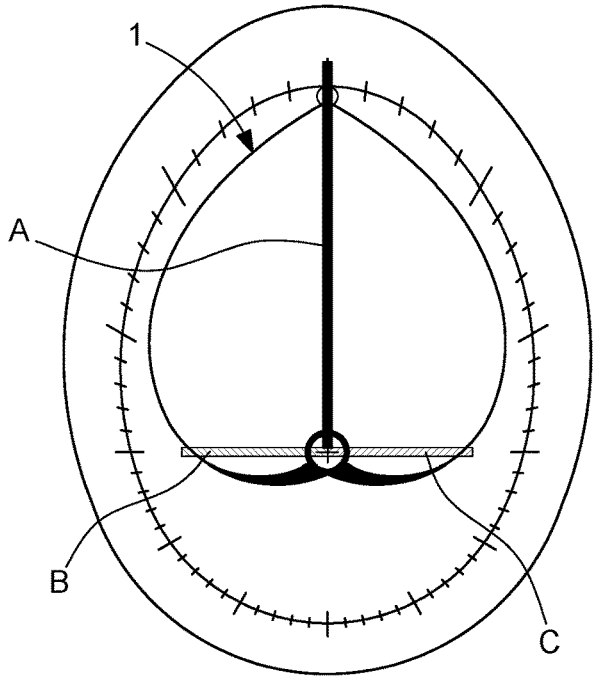
FIGS. 8 and 9 show, in a similar way to FIG. 4, the position of the differential plate and the positions of the arms of the elastic hand, respectively at noon in FIG. 8 and at four o'clock in FIG. 9.
Figure 9:
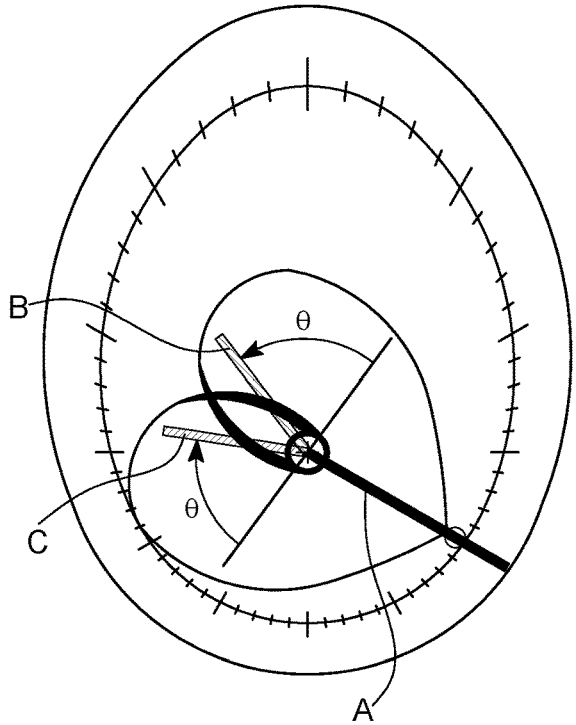
Figure 11:
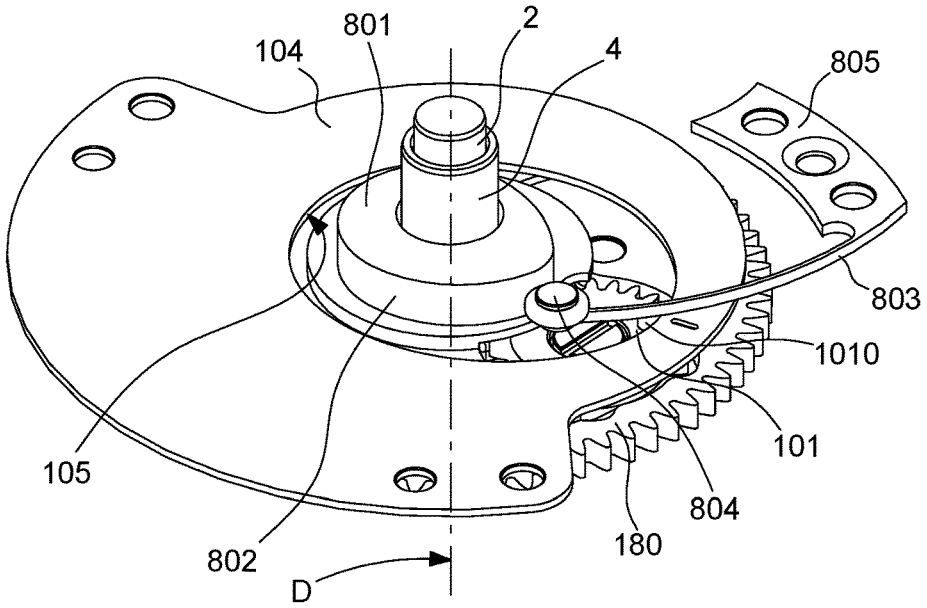
FIG. 11 shows, partially and schematically, in an assembled perspective, a display mechanism according to the invention, including a torque-regulating mechanism acting on a planet-carrier chassis.
Figure 12:
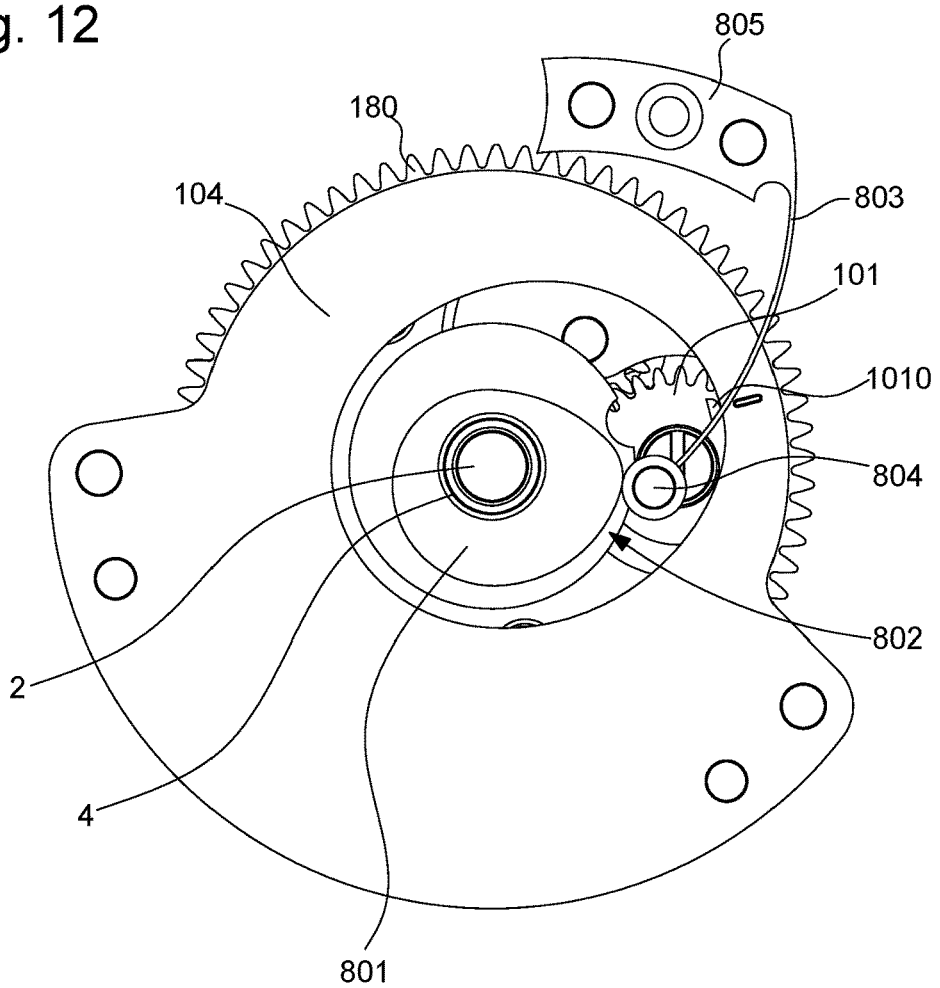
FIG. 12 shows, partially and schematically, in a top view, the mechanism of FIG. 11.

A particular actuation of the hand involves taking a differential planet-carrier plate as a reference frame, in such a way as to make each hand pipe work symmetrically. FIGS. 8 and 9 illustrate the angle of rotation to be imposed on the pipes 2 and 4 of the hand 1. In FIG. 8, the hand 1 indicates noon: the line A illustrates the position of the differential plate, which in this non-limiting example rotates at 1 revolution per hour, and the lines B and C indicate the positions of the arms of the hand 1. In FIG. 9, the hand 1 indicates four o'clock, the line A of the differential plate points to the mark at four o'clock on the dial, and each arm B, C, with respect to the planet carrier, has a gain and a symmetrical recoil by the same angle Θ.

The display mechanism 10 thus includes a differential mechanism including a input planet-carrier chassis 180 mounted free in rotation about the output shaft D. This input planet-carrier chassis 180 includes a first pivot 183 and a second pivot 181 respectively carrying an intermediate wheel 103 and a single planetary wheel 101 meshing with one another by their toothing 1039, 1019. This planetary wheel 101 includes an eccentric finger 1010, which is arranged to travel over an inner track 105 of a fixed cam 104, and which is returned against this inner track 105 by the elasticity of the elastic hand 1 itself. This input planet-carrier chassis 180 includes an input toothing 182, and a shaft 185 that carries, coaxial according to the output shaft D, a first cannon-pinion 1020 including the first pipe 2 and a second cannon-pinion 1040 including the second pipe 4, wherein the toothing 1049 of one meshes with the toothing 1039 of the intermediate wheel 103, and wherein the toothing 1029 of the other meshes with the toothing 1019 of the planetary wheel 101.

Figure 2:
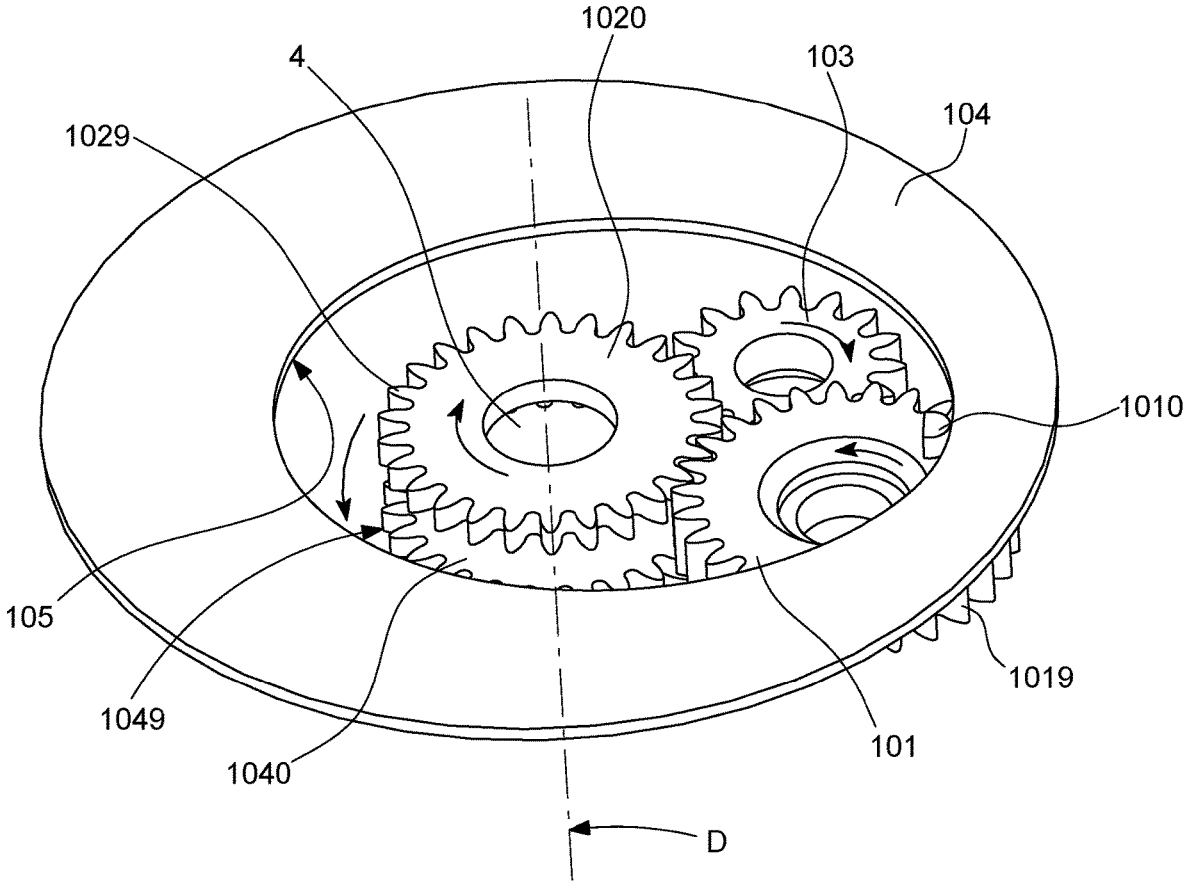
FIG. 2 shows, partially and schematically, in an assembled perspective, the mechanism of FIG. 1, without the planet-carrier plate.

Thus, the structure is simplified by the use of a single cam that feels the piece of information of the angular delta Θ to be applied. This piece of information is directly transmitted to a first cannon-pinion 1020. A second cannon-pinion 1040 receives this piece of information via an intermediate wheel 103 that inverts the direction of the angular delta Θ to be applied, as visible in FIGS. 2 and 3: a single planetary wheel 101, carried by the planet-carrier plate 180 feels, on a single cam 105 that a flange 104 includes, a single angular delta Θ to be applied to the two pipes of the hand 1.

The planetary wheel 101 applies the rotation directly to the first cannon-pinion 1020 carrying the first pipe 2. For the second cannon-pinion, the planetary wheel 101 transmits the rotation via the intermediate wheel 103 to the second cannon-pinion 1040 carrying the second pipe 4, in order to invert the direction of rotation.

The planetary wheel 101 carries a finger 1010 which feels the cam track 105.

Here, the planet-carrier plate 180 includes a tube 185 for guiding the cannon-pinions 1040 and indirectly 1020, and an outer toothing 182 driven by the horological movement, and pivots 181 and 183 for guiding the planetary wheel 101 and the intermediate wheel 103. The toothing 1019 of the planetary wheel 101 meshes on the one hand with the toothing 1029 of the first cannon-pinion 1020, and on the other hand with the toothing 1039 of the intermediate wheel 103, which meshes with the toothing 1049 of the second cannon-pinion 1040.

Figure 3:
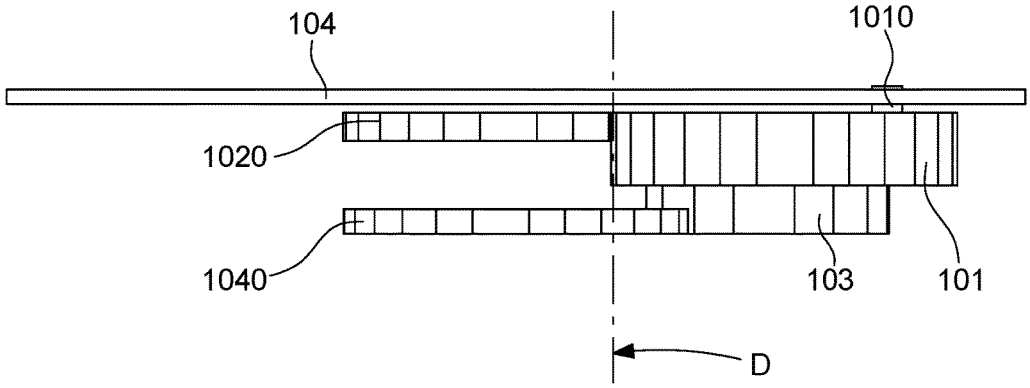
FIG. 3 shows, partially and schematically, in a side view, the mechanism of FIG. 2.
Figure 4:
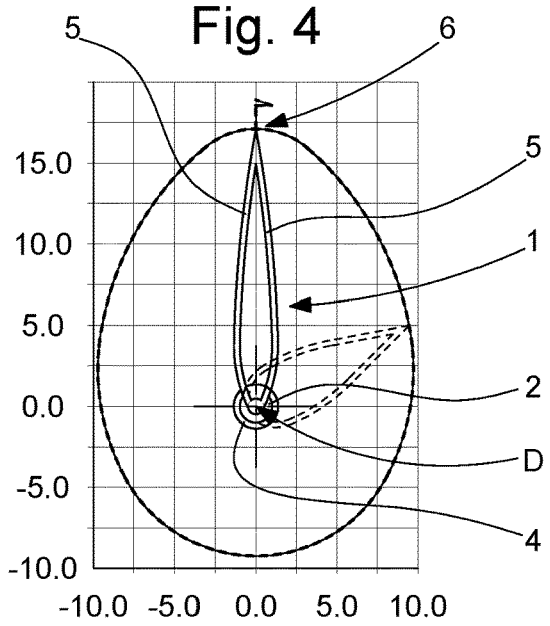
FIG. 4 shows, schematically and in a top view, an oval dial in front of which an elastic hand that includes such a display mechanism moves, which hand is shown in two different positions: at twelve o'clock with a solid line, and at two o'clock with a dotted line.

FIG. 3 shows that this mechanism is extremely compact, with a small thickness that allows its housing in a small watch case.

The number of components is reduced, and none has a particular complexity of production; the cost of the assembly is thus moderate.

The invention also relates to an horological movement 900 including at least one such display mechanism 10.

The invention also relates to a watch 1000 including at least one such movement 900, and/or at least one such display mechanism 10.

In summary, the invention allows to generate gain and/or loss on the two pipes of the elastic hand, allowing to generate complex trajectories, in a very simple, compact manner that consumes little torque and is thus very reliable.

This structure with a single planetary wheel and a single cam has many advantages. The additional plate is very simple. The single planetary wheel is mounted in a dragging way, and cannot butt in the clockwise direction. The energy consumption is low because of the reduced friction. The loss of amplitude at the resonator is very low. The mechanism includes few components, is not very voluminous, and its assembly remains easy.

The invention claimed is:

1. A horological display mechanism with a variable geometry, including at least one elastic hand which includes a first drive pipe rigidly connected to a first end of a flexible blade, and a second drive pipe rigidly connected to another end of said flexible blade, and including a display index which, in an unstressed free state of said elastic hand in which both said first pipe and said second pipe are not subjected to any stress and are distant from one another, is distant from said first pipe and from said second pipe, a service position of said elastic hand being a stressed position in which said first pipe and said second pipe are coaxial to one another about an output shaft, said display mechanism including first means for driving said first pipe about said output shaft, and second means for driving said second pipe about said output shaft, said first drive means and second drive means being arranged to deform said flexible blade, by varying an angular position of said second pipe with respect to an angular position of said first pipe about said output shaft, and to vary a radial position of said display index with respect to said output shaft, wherein said display mechanism includes at least one mechanism of a differential type acting on a drive train of the first pipe and on a drive train of said second pipe and wherein said differential mechanism includes at least a first planetary wheel for driving said first pipe and/or a second planetary wheel for driving said second pipe, and at least one input planet-carrier chassis driven in rotation by motor means for driving said elastic hand, and wherein said display mechanism includes a torque-regulating mechanism acting on said input planet-carrier chassis.

2. The display mechanism according to claim 1, wherein said torque-regulating mechanism includes, constrained to rotate with said input planet-carrier chassis, a regulation cam, a track of which comprises a continuous rising edge and falling edge, wherein said torque-regulating mechanism includes an elastic arm, a distal end of which, or a runner carried by said distal end opposite to a recess of the elastic arm, permanently cooperates with said track, the rising edge of which raises said elastic arm and moves the elastic arm away from an axis of rotation of said cam to consume torque, and the falling edge of which makes said elastic arm move back down towards the axis of rotation of said cam to restore torque to the system.

3. The display mechanism according to claim 2, wherein said track is symmetrical with respect to a plane passing through said output shaft) of the input planet carrier.

4. The display mechanism according to claim 3, wherein said track has an ovoid profile.

5. The display mechanism according to claim 1, wherein said input planet-carrier chassis is mounted free in rotation about said output shaft, and includes a first pivot and a second pivot respectively carrying an intermediate wheel and a planetary wheel meshing with one another by a toothing of the intermediate wheel and a toothing of the planetary wheel, said planetary wheel including an eccentric finger, which is arranged to travel over an inner track of a fixed cam, and which is returned against said inner track by the elasticity of said elastic hand, said input planet-carrier chassis including an input toothing, and a shaft that carries, coaxial according to said output shaft, a first cannon-pinion including said first pipe and a second cannon-pinion including said second pipe, wherein a toothing of the second cannon-pinion meshes with the toothing of said intermediate wheel, and wherein a toothing of the first cannon-pinion meshes with the toothing of said planetary wheel.

6. A horological movement including at least one display mechanism according to claim 1.

7. A watch including at least one horological movement according to claim 6.

* * * * *